US006710722B2

(12) United States Patent
Lee

(10) Patent No.: US 6,710,722 B2
(45) Date of Patent: Mar. 23, 2004

(54) TRAFFIC LIGHT CONTROL AND INFORMATION TRANSMISSION DEVICE

(75) Inventor: Hsi-Che Lee, No. 6, Lane 99, Chang Ji St., Taipei (TW)

(73) Assignees: Hsi-Che Lee, Taipei (TW); Tung-Hsing Pan, Taipei (TW); Mei-Jiuan Chen, Taipei (TW)

( * ) Notice: Subject to any disclaimer, the term of this patent is extended or adjusted under 35 U.S.C. 154(b) by 58 days.

(21) Appl. No.: 10/190,541

(22) Filed: Jul. 9, 2002

(65) Prior Publication Data

US 2003/0020633 A1 Jan. 30, 2003

(51) Int. Cl.[7] ..... G08G 7/095; G08G 7/07; G08G 7/08; G08G 7/054

(52) U.S. Cl. ..... 340/910; 340/907; 340/909; 340/916; 340/937

(58) Field of Search ..... 340/907, 909, 340/911, 915, 916–919, 924, 925, 937

(56) References Cited

U.S. PATENT DOCUMENTS 3,652,983 A * 3/1972 Endo et al. ..... 340/913
3,660,812 A * 5/1972 Inose et al. ..... 340/911
3,675,196 A * 7/1972 Molloy et al. ..... 340/912
3,792,431 A * 2/1974 Matysek ..... 340/909
6,377,191 B1 * 4/2002 Takubo ..... 340/937
6,411,328 B1 * 6/2002 Franke et al. ..... 348/149
6,573,929 B1 * 6/2003 Glier et al. ..... 348/149

* cited by examiner

*Primary Examiner*—Jeffery Hofsass
*Assistant Examiner*—Lam Pham
(74) *Attorney, Agent, or Firm*—Rabin & Berdo, P.C.

(57) ABSTRACT

A traffic light control and information transmission device compromising a microprocessor on the cross road, the microprocessor further connects to a traffic light controller, an electronic display board, a video camera, a compression circuitry, an I/O interface, a traffic flow detector and connected to the central traffic control computer through the DSL (Digital Subscriber Loop). The control signals, traffic, public information or news of the central traffic control computer can go through the DLS to the microprocessor; the microprocessor can control the traffic light and display all the information on the electronic display board. The traffic flow data of the cross roads can be accessed by the traffic flow detector and the video camera and transmitted back to the central traffic control computer.

3 Claims, 2 Drawing Sheets

TRAFFIC LIGHT CONTROL AND INFORMATION TRANSMISSION DEVICE

BACKGROUND OF THE INVENTION

I. Field of the Invention

This invention relates generally to a traffic light control and information transmission device and, more specifically, to a traffic light control and information transmission device that consists of a microprocessor on the cross road, the microprocessor further connects to a traffic light controller, an electronic display board, a video camera, a compression circuitry, an I/O interface, a traffic flow detector and connected to the central traffic control computer through the DSL (Digital Subscriber Loop). The control signals, traffic, public information or news of the central traffic control computer can go through the DLS to the microprocessor; the microprocessor can control the traffic light and display all the information on the electronic display board. The traffic flow data of the cross roads can be accessed by the traffic flow detector and the video camera and transmitted back to the central traffic control computer. This scheme applies the existing broadband network to transmit data between the central traffic control computer and the microprocessors of the cross roads to avoid the installation of the cables and save the construction cost.

II. Description of the Prior Art

Heretofore, it is known that a traffic light applies red, yellow and green light to control the traffic direction and flow, the control of the traffic light is done by the local control box or by the computer in the remote central traffic control office so that the traffic flow can be controlled under normal.

Cables and/or wires must be installed between every control box of the traffic light and the central computer to transmit the control signals and data; two ways to install the cables: above ground and underground. The above ground method is to have the cables hang over the electrical poles, however this method makes the city scene ugly, therefore this method is gradually not applied. The underground method is to bury the cables underground, this method can avoid the ugly scene issue; however in order to bury the cables underground, the road must be diged first, the road work will interfere the traffic flow on the daylight, therefore the work must be done in the evening, to work in the evening costs higher than that of the daylight. The underground method costs much higher than the above ground method.

The length of the cable is the distance of the traffic control box and the central computer; the cost of cable is also very high.

SUMMARY OF THE INVENTION

It is therefore a primary object of the invention to provide a traffic light control and information transmission device that applies the existing broadband network to transmit data between the central traffic control computer and the microprocessors of the cross roads to avoid the installation of the cables and save the construction cost.

In order to achieve the objective set forth, a traffic light control and information transmission device in accordance with the present invention comprises a microprocessor on the cross road, the microprocessor further connects to a traffic light controller, an electronic display board, a video camera, a compression circuitry, an I/O interface, a traffic flow detector and connected to the central traffic control computer through the DSL (Digital Subscriber Loop). The control signals, traffic, public information or news of the central traffic control computer can go through the DSL to the microprocessor; the microprocessor can control the traffic light and display all the information on the electronic display board. The traffic flow data of the cross roads can be accessed by the traffic flow detector and the video camera and transmitted back to the central traffic control computer.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
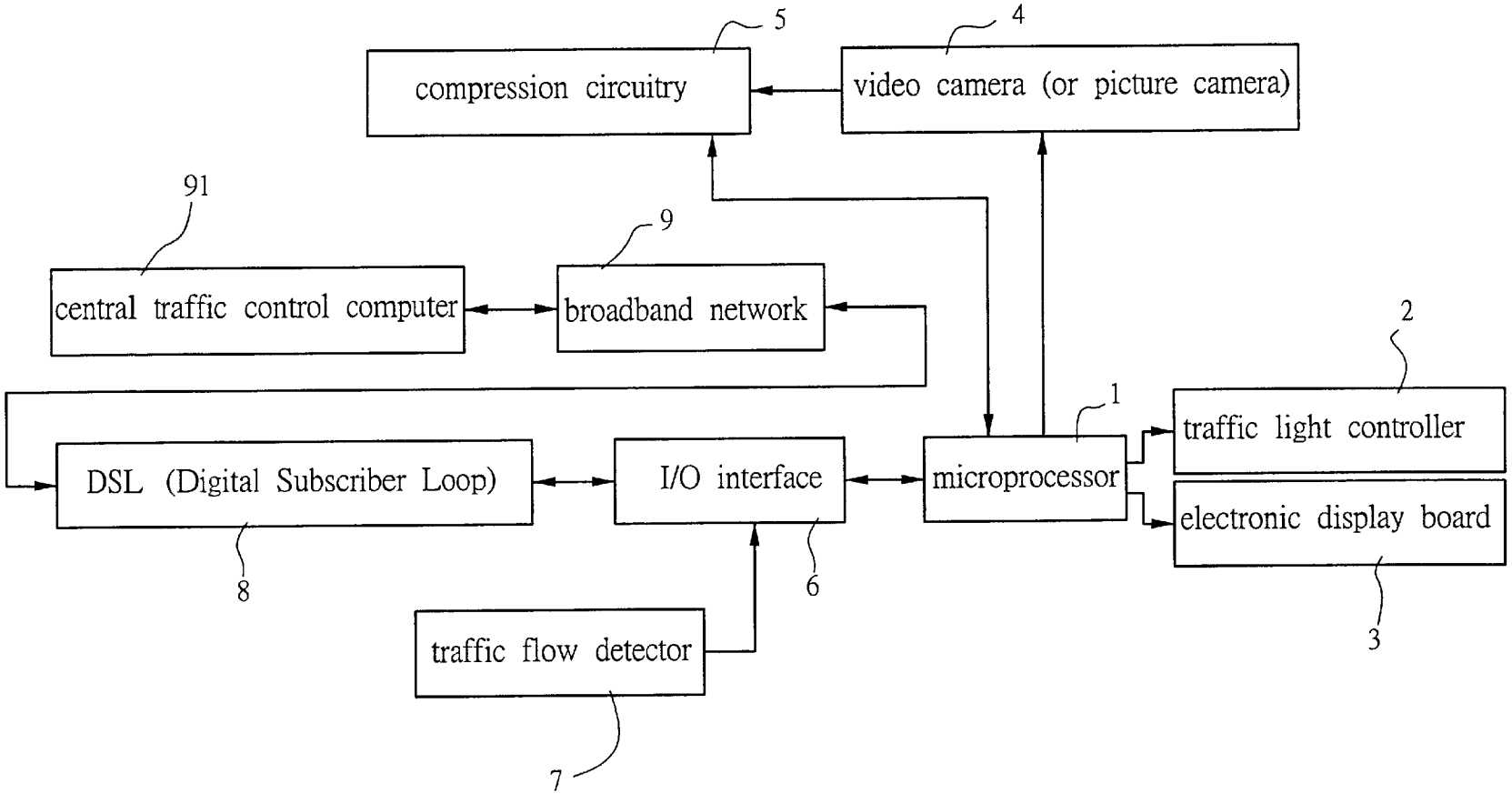
FIG 1 is a circuit block diagram of the present invention.

Referring to FIG. 1, the components of the present invention are described below:

The microprocessor 1 is inside the traffic control box of the traffic light and to control all the circuitries.

The traffic light controller 2 is connected to and controlled by the microprocessor 1 to send out the stop, go and direction signals.

The electronic display board 3 is connected to and controlled by the microprocessor 1 to display characters, patterns and graphic images.

The video camera 4 is connected to and controlled by the microprocessor 1 to monitor the traffic flow.

The compression circuitry 5 connects to the microprocessor 1 and the video camera 4, the compression circuitry 5 compresses the image data captured by the video camera 4 and sends the compressed data to the microprocessor 1.

The I/O interface 6 connects to the microprocessor 1 and receives, transmits data and control signals.

The traffic flow detector 7 connects to the I/O interface 6 and gathers the traffic flow information; the traffic flow information is input to the microprocessor 1.

The DSL (Digital Subscriber Loop) 8 connects to the I/O interface 6 and receives, transmits data and control signals.

The broadband network 9 links the DSL 8 and the central traffic control computer 91 together; the central traffic control computer 91 sends and receives the data and controls signals to the microprocessor through the broadband network 9.

The video camera 4 can be a picture camera; the DSL 8 can be a cable modem, ADSL, VDSL, or XDSL as needed.

Figure 2:
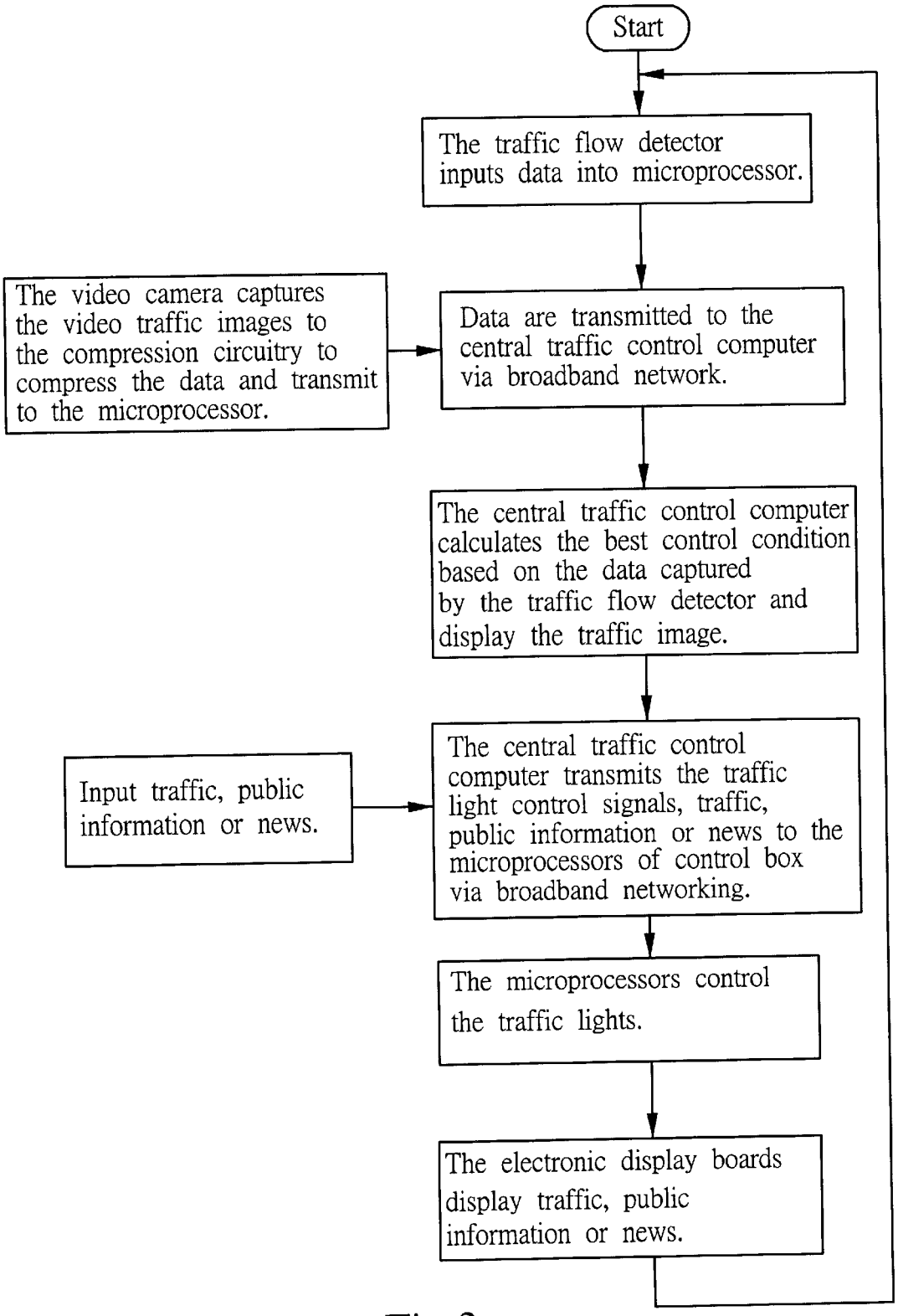
FIG. 2 is a flowchart of the present invention.

Based on above structure and referring to the flow chart shown in FIG. 2, the traffic flow detector 7 on the cross roads gather the traffic flow information and pass the data to the microprocessor 1 through the I/O interface 6; the video camera 4 (or picture camera) inputs the traffic flow images to the compression circuitry 5, those data are converted into digital signals by the compression circuitry 5 and input to the microprocessor 1. The DSL 8 transmits the data by the traffic flow detector 7 and the video camera 4 (or picture camera) through the broadband network 9 to the central traffic control computer 91, the central traffic control computer 91 calculates the best control timing for the traffic light controller 2 and transmits the best control timing through the broadband network 9, the DSL 8 (or cable modem) receives the best control timing and then transmits those to the microprocessor 1, the microprocessor 1 can response accordingly to the traffic light controller 2.

Based on above description, the communication between the microprocessor 1 on the cross roads and the central traffic control computer 91 on the central office is through the existing broadband network 9, therefore this scheme can avoid the inconvenience and tedious of the installation of the cables; the installation, road work cost can be minimized.

The traffic, public information or news can also go from the central traffic control computer 91 and through the broadband network 9, the microprocessor 1 on the cross roads can receive those information and display those messages on the electronic display board 3, all the drivers can be informed.

While a preferred embodiment of the invention has been shown and described in detail, it will be readily understood and appreciated that numerous omissions, changes and additions may be made without departing from the spirit and scope of the invention.

What is claimed is:

1. A traffic light control and information transmission device comprising:

a microprocessor located inside the traffic control box and to control all the circuitries;

a traffic light controller connected to and controlled by said microprocessor to send out the stop, go and direction signals;

an electronic display board connected to and controlled by said microprocessor to display characters, patterns and graphic images;

a video camera connected to and controlled by said microprocessor to monitor the traffic flow;

a compression circuitry connected to said microprocessor and said video camera, said compression circuitry compresses the image data captured by said video camera and sends the data to said microprocessor;

an I/O interface connected to said microprocessor to receive, transmit data and control signals;

a traffic flow detector connected to said I/O interface and gathering the traffic flow information; the traffic flow information is input to said microprocessor;

a DSL connected to said I/O interface 6 and receiving, transmitting data and control signals;

a broadband network linking said DSL and a central traffic control computer together, said central traffic control computer sends out and receives the data and controls signals to said microprocessor through said broadband network.

2. The traffic light control and information transmission device recited in claim 1, wherein said video camera can be a picture camera.

3. The traffic light control and information transmission device recited in claim 1, wherein said DSL can be a cable modem, ADSL, VDSL, or XDSL.

* * * * *